US008142586B2

(12) United States Patent
Park et al.

(10) Patent No.: US 8,142,586 B2
(45) Date of Patent: Mar. 27, 2012

(54) METHOD FOR MANUFACTURING A FIBER-REINFORCED COMPOSITE SABOT BY USING RESIN-INJECTION VACUUM ASSISTED RESIN TRANSFER MOLDING AFTER STITCHING

(75) Inventors: In-Seo Park, Daejeon-si (KR); Jin-Seok Kim, Daejeon-si (KR); Seung-Un Yang, Changwon-si (KR); Young-Jun Jeon, Gimhae-si (KR)

(73) Assignee: Agency for Defense Development, Yuseong-gu, Daejeon-si (KR)

( * ) Notice: Subject to any disclaimer, the term of this patent is extended or adjusted under 35 U.S.C. 154(b) by 635 days.

(21) Appl. No.: 12/236,469

(22) Filed: Sep. 23, 2008

(65) Prior Publication Data

US 2010/0276830 A1 Nov. 4, 2010

(30) Foreign Application Priority Data

Oct. 31, 2007 (KR) ..... 10-2007-0109931

(51) Int. Cl.
*B32B 7/08* (2006.01)
*B29C 70/36* (2006.01)
*F42B 14/06* (2006.01)

(52) U.S. Cl. ..... 156/93; 156/154; 156/245; 156/285; 102/521

(58) Field of Classification Search ..... 156/93, 156/154, 245, 256, 285, 286; 102/520–523
See application file for complete search history.

(56) References Cited

U.S. PATENT DOCUMENTS

| | | | | |
|---|---|---|---|---|
| 4,735,148 | A | 4/1988 | Holtzman | |
| 4,942,013 | A * | 7/1990 | Palmer et al. | 264/511 |
| 4,958,571 | A | 9/1990 | Puckett | |
| 5,635,660 | A | 6/1997 | McGovern | |
| 5,640,054 | A | 6/1997 | McGovern | |
| 5,789,699 | A | 8/1998 | Stewart | |
| 6,125,764 | A | 10/2000 | Kamdar | |
| 6,186,094 | B1 | 2/2001 | Kamdar | |
| 6,241,506 | B1 | 6/2001 | Kassuelke | |
| 6,279,214 | B1 | 8/2001 | Kassuelke | |
| 7,013,811 | B1 | 3/2006 | Sebasto | |
| 2006/0172636 | A1 * | 8/2006 | Bech | 442/1 |

FOREIGN PATENT DOCUMENTS

| | | |
|---|---|---|
| EP | 0982561 | 3/2000 |
| EP | 0989382 | 3/2000 |

* cited by examiner

*Primary Examiner* — Michael Tolin
(74) *Attorney, Agent, or Firm* — Cahn & Samuels, LLP

(57) ABSTRACT

Disclosed is a method for manufacturing a fiber-reinforced composite sabot for use in APFSDS (Armor. Piercing Fin Stabilized Discarding Sabot) wherein a plurality of fiber mats are laminated instead of one-directional prepreg ply and whole part is reinforced by stitching through long fiber bundle in order to enhance circumferential shear strength, and high quality fiber-reinforced composite sabot is manufactured in a short time using resin-injection vacuum assisted resin transfer molding after stitching.

10 Claims, 9 Drawing Sheets

METHOD FOR MANUFACTURING A FIBER-REINFORCED COMPOSITE SABOT BY USING RESIN-INJECTION VACUUM ASSISTED RESIN TRANSFER MOLDING AFTER STITCHING

CROSS-REFERENCE TO RELATED APPLICATIONS

This application claims priority to Republic of Korea application number 10-2007-0109931, filed on Oct. 31, 2007, which is hereby incorporated by reference in its entirety

TECHNICAL FIELD

The present invention relates to a method for manufacturing a composite sabot, and more specifically, to a method for manufacturing a fiber-reinforced composite sabot for use in APFSDS (Armor Piercing Fin Stabilized Discarding Sabot) wherein a plurality of fiber mats are laminated instead of one-directional prepreg ply and whole part is reinforced by stitching through long fiber bundle in order to enhance circumferential shear strength, and high quality fiber-reinforced composite sabot is manufactured in a short time using resin-injection vacuum assisted resin transfer molding after stitching.

PRIOR ARTS

Aluminum alloy is generally used for manufacturing the sabot for the APFSDS which is used for antitank guns. However, by using the high-strength fabric-reinforced composite material having lower density than the aluminum on the sabot, the speed of the shell can be increased with the same energy thereby enhancing the power of the shell. Therefore wide range of research has been made in the field to manufacture lighter and better sabot by replacing the metal sabot with polymer based fiber-reinforced material having specific strength. The sabot is combined to the outer diameter of the penetrator with three separated pieces and guides the sabot in the gun barrel, delivers the propulsive force to the penetrator, and is separated from the penetrator after the penetrator is propelled from the barrel playing the role of structurally supporting the sabot and preventing leakage of pressure from the barrel. Therefore the weight of the sabot is very important in improving the performance of the whole system, so by making the sabot as light as possible, more of propulsive force is delivered to the penetrator ensuring stable flight of the penetrator.

Also, in order to deliver the propulsive force to the penetrator more efficiently, inner part of the sabot is formed a concave-convex combining surface in the form of spiral or groove in the contacting surface with the penetrator. The outer part of the sabot is formed so that the sabot closely contact the barrel sealing the barrel so that the pressure for the propulsive force is maintained. After the penetrator is separated from the barrel, the sabot is separated from the penetrator through friction with the air without affecting the propulsion of the penetrator.

FIG. 6 shows the cross section of the conventional aluminum sabot which shows that the sabot 3 is composed of three pieces and combined with the penetrator 2 of the APFSDS in the barrel 1 of the tank or armored vehicle.

Between the outer part of the penetrator 2 and the inner part of the corresponding sabot 3, is formed a concave-convex combining part 2*a*, 3*a* in the form of spiral or groove, and this concave-convex combining part 2*a*, 3*a* is formed not to be damaged considering the shearing stress from the propulsion force.

The sabot made by the conventional method is made from aluminum and although presents no problem in endurance considering the shearing stress required at the time of propulsion, relatively high weight compared to the composite sabot causes problem in important properties of the penetrator such as aviation velocity, penetration strength on the target and other overall properties of the system.

Also, since lamination in the radial direction has been reportedly adopted since the conventional lamination method in axial or circumferential direction cannot obtain the required mechanical strength of the groove. Lamination in the radial direction uses prepreg made of unidirectional fiber or fabric fiber/resin, and the prepreg ply is laminated in orthogonal direction on the groove surface contacting the penetrator providing much improved shear strength compared to the above mentioned conventional lamination method in axial or circumferential direction. However, while the required strength in the same or orthogonal direction of the contacting the penetrator is obtained in the radial direction lamination, there is a problem of low adhesive strength in the direction in which the prepreg ply is laminated, and so there has been need for developing technology that can improve this strength.

Until recently, the patent application relating radial directional lamination has been directed to the lamination technology or orientation of the fiber, for example U.S. Pat. No. 5,640,054 (Sabot segment molding apparatus and method for molding a sabot segment), and U.S. Pat. Nos. 5,789,699 (Composite ply architecture for sabot) and 6,125,764 (Simplified tailored composite architecture).

The method of using high strength resin can be considered in order to reinforce the material property in the laminating direction, but the cost will be increased due to the high price of the material and complex manufacturing method.

The previous composite sabots manufactured only in the radial or circumferential laminating method generated the delamination phenomenon from the severe bending of fiber. Accordingly, applying the band lamination and the hoop lamination on the external layer of radial lamination made it possible to endure from the high expansion power to operate in the circumference direction in shooting the shells. Also the lamination improving the previous segment lamination shape made the surface of 120° not to be damaged in the process of sabots.

OBJECTIVE OF THE INVENTION

The present invention has been designed to solve the above mentioned problems of prior arts. In order to provide a method for manufacturing a composite sabot and to prevent delamination composite sabot, reinforcement material such as long fiber bundle is stitched along the short edge direction of the preformed laminated fabric to connect them physically, adhesiveness and straining force in the circumferential direction can be enhanced with cost-effective 3-dimensional structure compared with the conventional 2-dimensional composite sabot composed of prepreg ply including one directional fiber or fabric fiber.

DISCLOSURE OF THE INVENTION

To solve the above problems of the prior arts, the present invention provides a method for manufacturing a fiber-reinforced composite sabot comprising: the step of preparing a plurality of fiber mats having various orientation properties and forms by cutting fabric mat; the step of forming pre-formed fabric object by laminating the plurality of fiber mats and stitching with reinforcing material; the step of forming composite material by inserting the pre-formed fabric object into resin-injection VARTM apparatus and performing resin-injection VARTM; the step of forming three pieces of sabot by mechanically processing the formed composite material; and forming a sabot by combining the three pieces.

According to the method for manufacturing a fiber-reinforced composite sabot, in the step of forming pre-formed fabric object, lamination of the plurality of fiber mats is performed considering the orientation properties of the fabric mat.

Also, in the step of forming pre-formed fabric object, stitching is preferably performed penetrating through the short edge direction of the fabric mat laminated with reinforcement material composed of long fiber bundle.

Further, the fiber of the fabric mat is favorably one or more of fiber selected from the group consisting of carbon fiber, graphite fiber and glass fiber.

Also, the long fiber of the reinforcement material is one or more of fiber selected from the group consisting of carbon fiber, graphite fiber, aramid fiber and glass fiber.

Finally, the resin inserted into resin-injection VARTM apparatus is thermosetting or thermoplastic resin.

INDUSTRIAL EFFECT

According to the method for manufacturing a fiber-reinforced composite sabot wherein a plurality of fiber mats are laminated and whole part is reinforced by stitching through long fiber bundle, the weight of the sabot can be reduced by 30% compared to conventional aluminum sabot. By improving the adhesiveness in the radial direction by depositing short fiber, the sabot is protected from the expansion pressure resulting from the high impact energy inside the barrel, providing optimal design requirement that can endure the destructing force of the sabot.

Further, by producing the sabot through resin-injection VARTM, high quality fiber reinforced composite sabot can be produced in short time compared with the conventional production method which used molding with necessary pressure and temperature.

BRIEF DESCRIPTION OF DRAWINGS

FIG. 3(*b*) is a side view of the preformed fabric object stitched with long fabric.

FIG. 6(*b*) is a perspective view showing the appearance of the processed piece.

DESCRIPTION ON THE NUMERAL OF THE DRAWINGS

Figure 1:
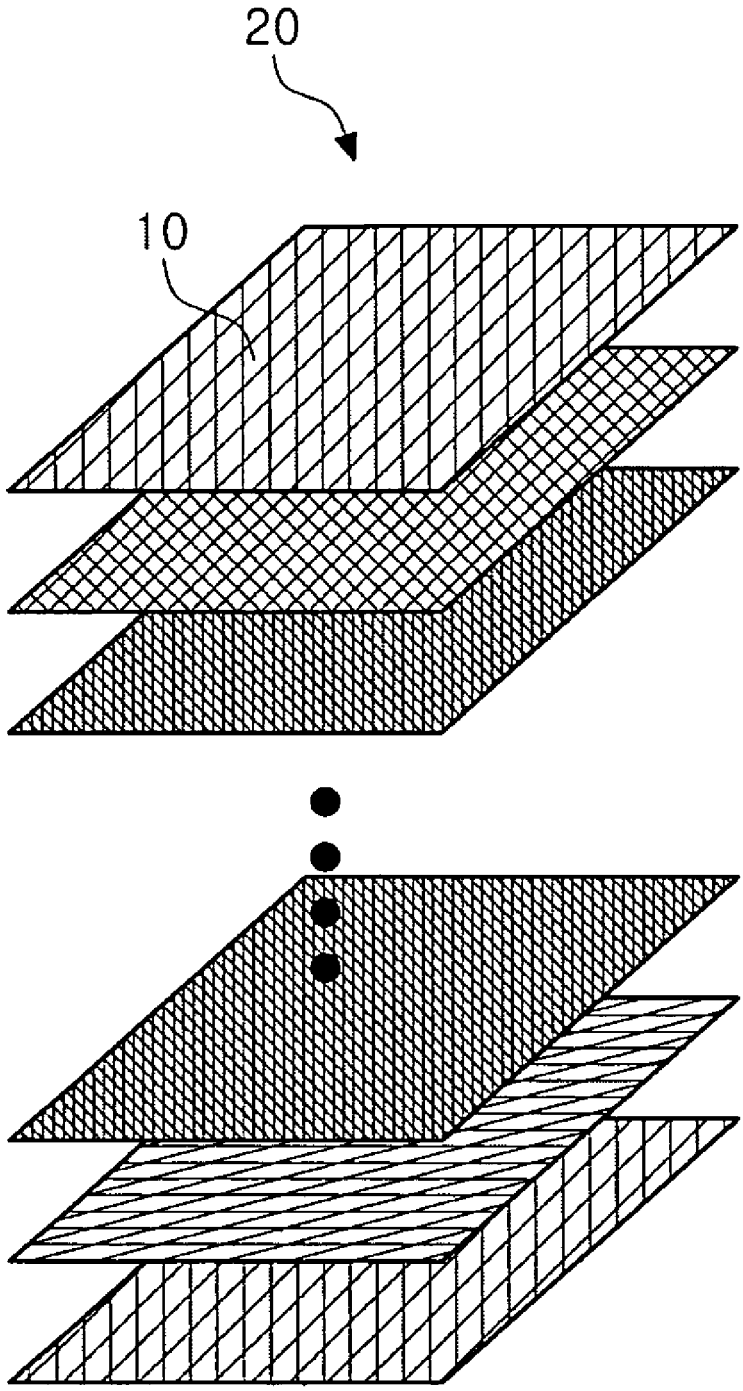
FIG. 1 is a perspective view illustrating distributed fiber mats for laminating.

10: fabric mat
20: laminated fabric mat
30: reinforcement material
40: stitched preformed object
50: resin outlet
60: resin inlet
70: vacuum bag
80: flow network
90: formed composite material object
100: piece of composite sabot
110: distribution of propulsive force in the barrel
120: fiber reinforced composite sabot

BEST MODE

Example of the present invention will be described with reference to the drawings attached.

FIG. 1 is a perspective view illustrating a plurality of distributed fiber mats 10 for laminating. The fiber mat 10 is fabricated using one or more of fiber selected from the group consisting of carbon fiber, graphite fiber and glass fiber. Regarding the orientation property of the fabric mat, it can be in the form of quadrilateral fabricated with the right angle, or in the form of parallelogram or lozenge.

The fiber mats 10 which are prepared in this way is cut into a predetermined form considering the orientation property of each fabric mat, and the plurality of fiber mats are laminated. The laminated fabric mats 20 are stitched with the reinforcement material 30 shown in FIG. 2 which is composed of long fabric bundle.

The stitching is performed in the direction of short edge of the laminated fabric mat 20 continuously penetrating the reinforcement material 30.

Figure 2:
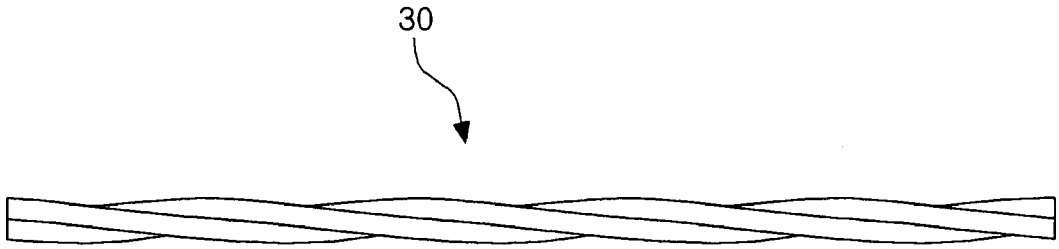
FIG. 2 is a side view showing the twisted form of the fabric of the reinforcement material composed of long fabric bundle.

There are many methods generally used for the fiber reinforced composite material process in order to reinforce the material property in the short edge direction of the material such as braiding, needle-punching or stitching. The present invention employed stitching technology in the manufacturing of composite sabot considering productivity and cost effectiveness. The long fabric comprising the reinforcement material is one or more of fiber selected from the group consisting of carbon fiber, graphite fiber, aramid fiber and glass fiber and preferably in the form of a plurality of twisted fabric as shown in FIG. 2.

Figure 3A:
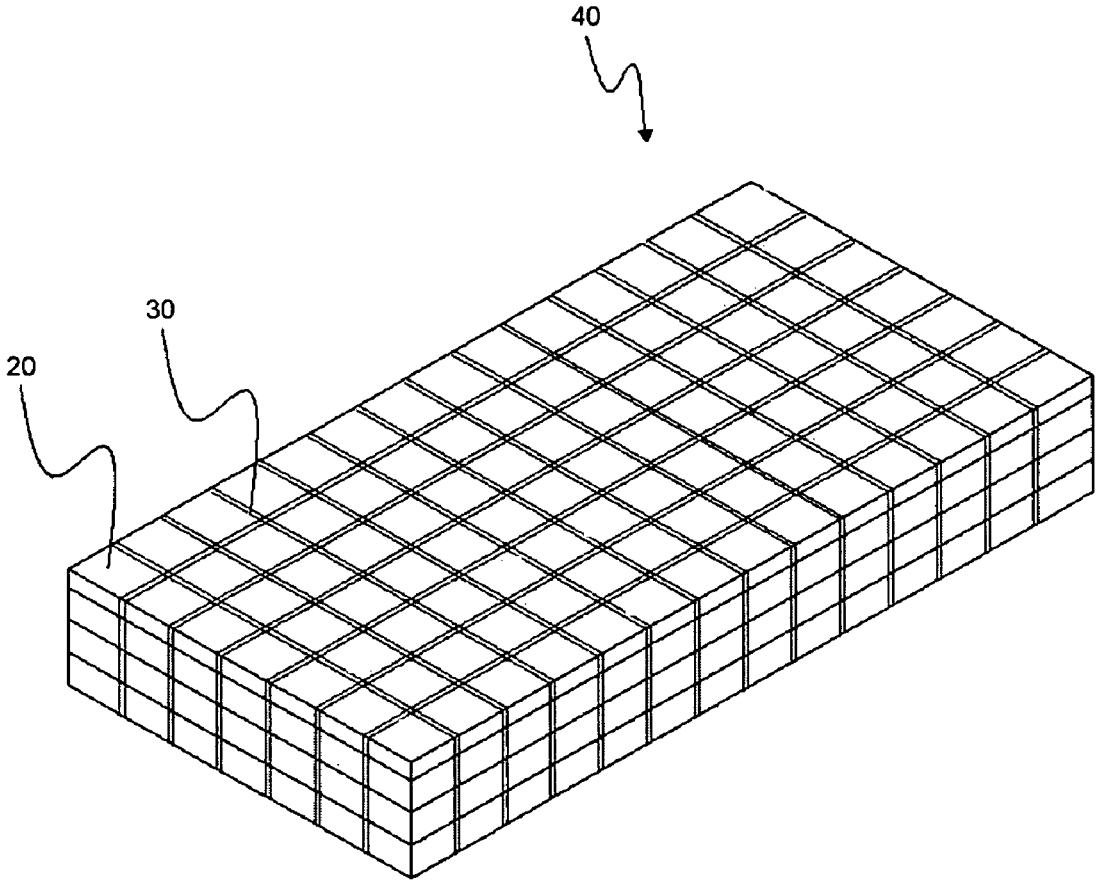
FIG. 3(*a*) illustrates the preformed fabric object stitched with long fabric.
Figure 3B:
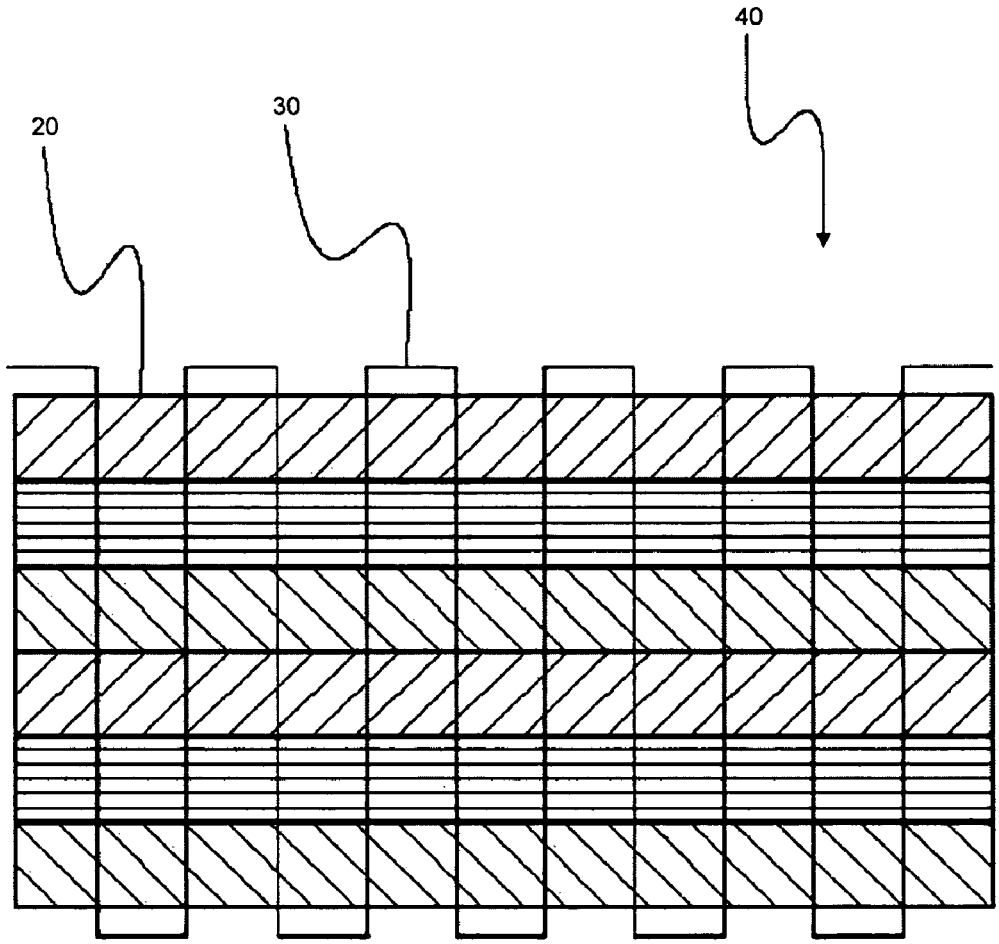

FIG. 3(*b*) is a side view of the preformed fabric object 40 formed by stitching reinforcement material 30 on the laminated fabric mat 20. FIG. 3(*a*) illustrates the appearance of the preformed fabric object 40 in which the reinforcement material 30 is stitched in the perpendicular direction.

Figure 4:
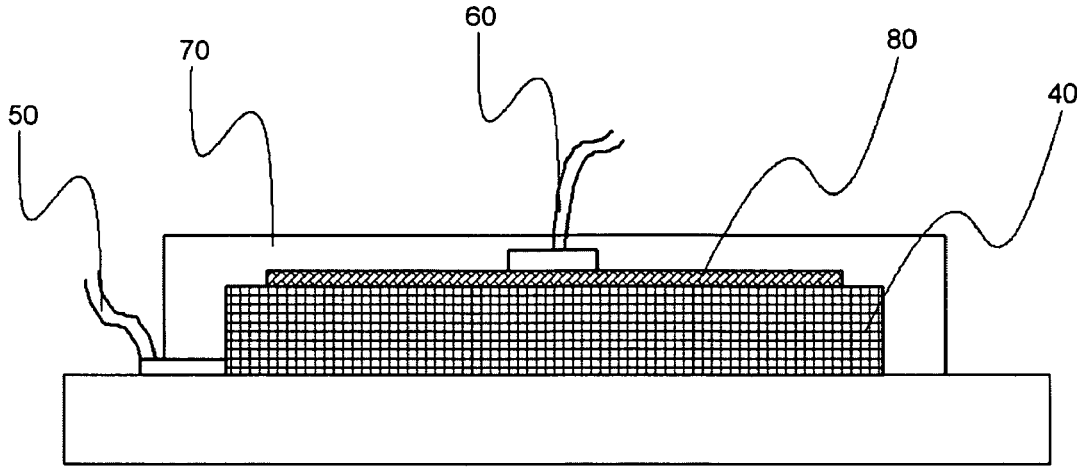
FIG. 4 illustrates forming the composite material by inserting the preformed fabric object into resin-injection VARTM.

FIG. 4 illustrates forming the composite material by inserting the preformed fabric object 40 into resin-injection VARTM apparatus and performing into resin-injection VARTM. Resin-injection VARTM(Vacuum-assisted resin transfer molding) method is widely used in forming composite material, especially in manufacturing fiber-reinforced plastic and will be described schematically here without specific details.

As shown in FIG. 4, preformed fabric object 40 is mounted on the mold of the resin-injection VARTM and resin flow network 80 is laminated for easy flow of the resin. The flow network 80 helps the uniform impregnation of the resin on the preformed fabric object 40 by absolving liquid resin inserted through the resin inlet 60. Therefore, the resin flow network 80 is generally made of net of plastic material with predetermined thickness. The inserted resin is thermosetting or thermoplastic resin.

Figure 5:
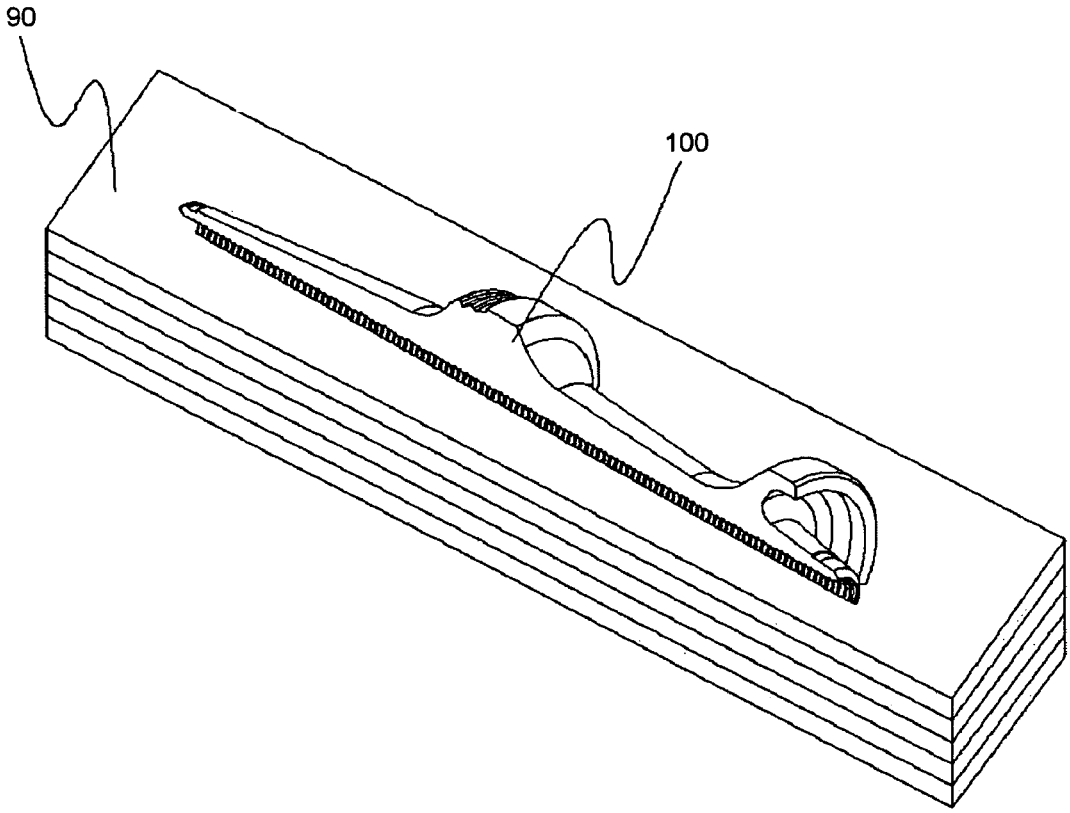
FIG. 5 illustrates the processing of the composite sabot from the formed composite material.
Figure 6A:
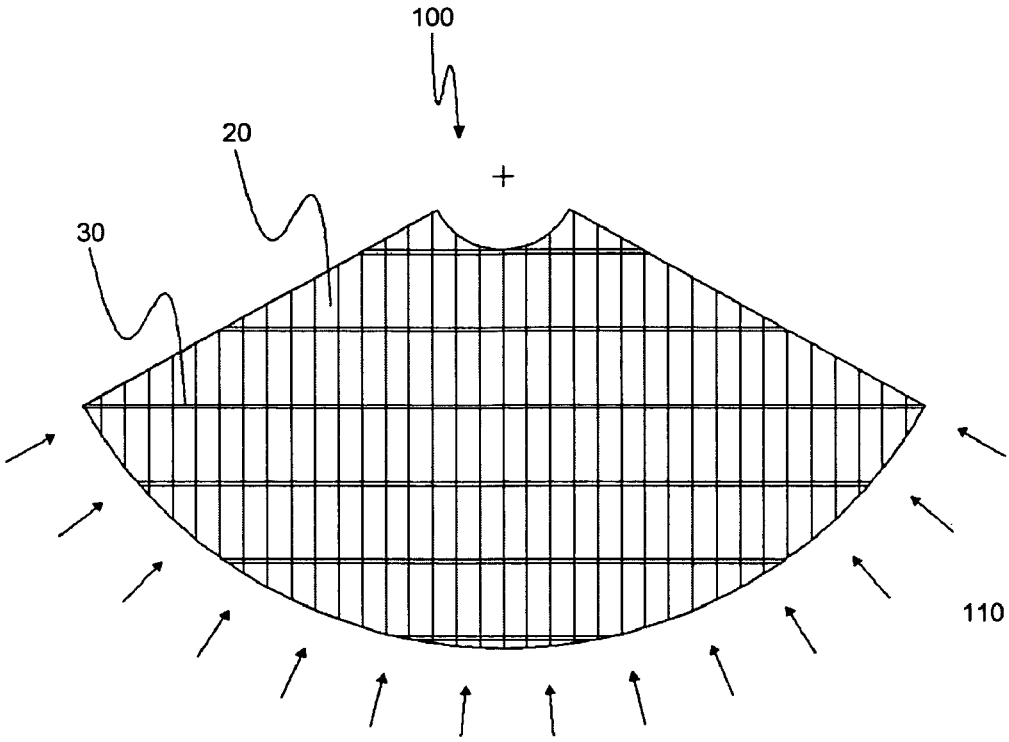
FIG. 6(*a*) is a longitudinal cross sectional view showing the piece composing a composite sabot.
Figure 6B:
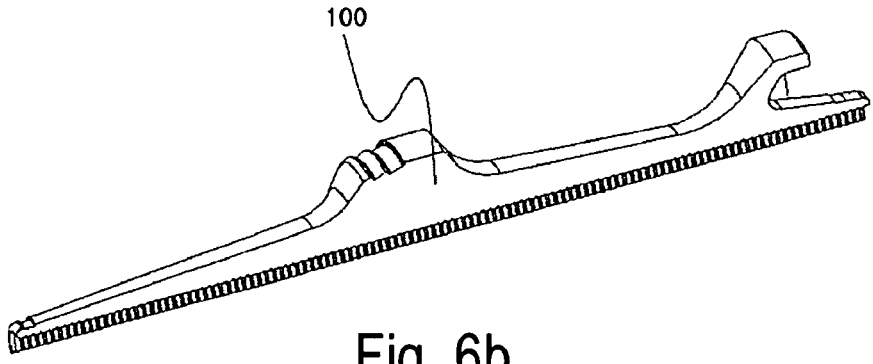

After laminating the resin flow network 80 on the preformed fabric object 40, resin inlet 60 and resin outlet 50 are fixed on the predetermined place of the preformed fabric object 40 and rendered vacuum by using vacuum bag 70. After vacuuming, resin is inserted into the preformed fabric object, and after impregnation, resin inlet 60 and resin outlet 50 are separated. Molding can be more close and strong by applying required heat. FIG. 5 illustrates processed composite material object 90 from the formed composite material in the form of rectangular parallelepiped. By mechanically processing this composite material object 90 according to the designed unit, i.e. the dashed line in FIG. 5, one piece 100 of composite sabot as shown in FIG. 6*b* can be obtained. When mechanically processing the composite material object, the lamination orientation of the fabric mat formed inside the piece 100 and the orientation of the stitched reinforcement material should preferably be arranged as shown in FIG. 6*a*. In this way of producing the sabot by combining the piece 100, the strength of the sabot required to endure the explosive pressure in the barrel can be obtained.

Figure 7:
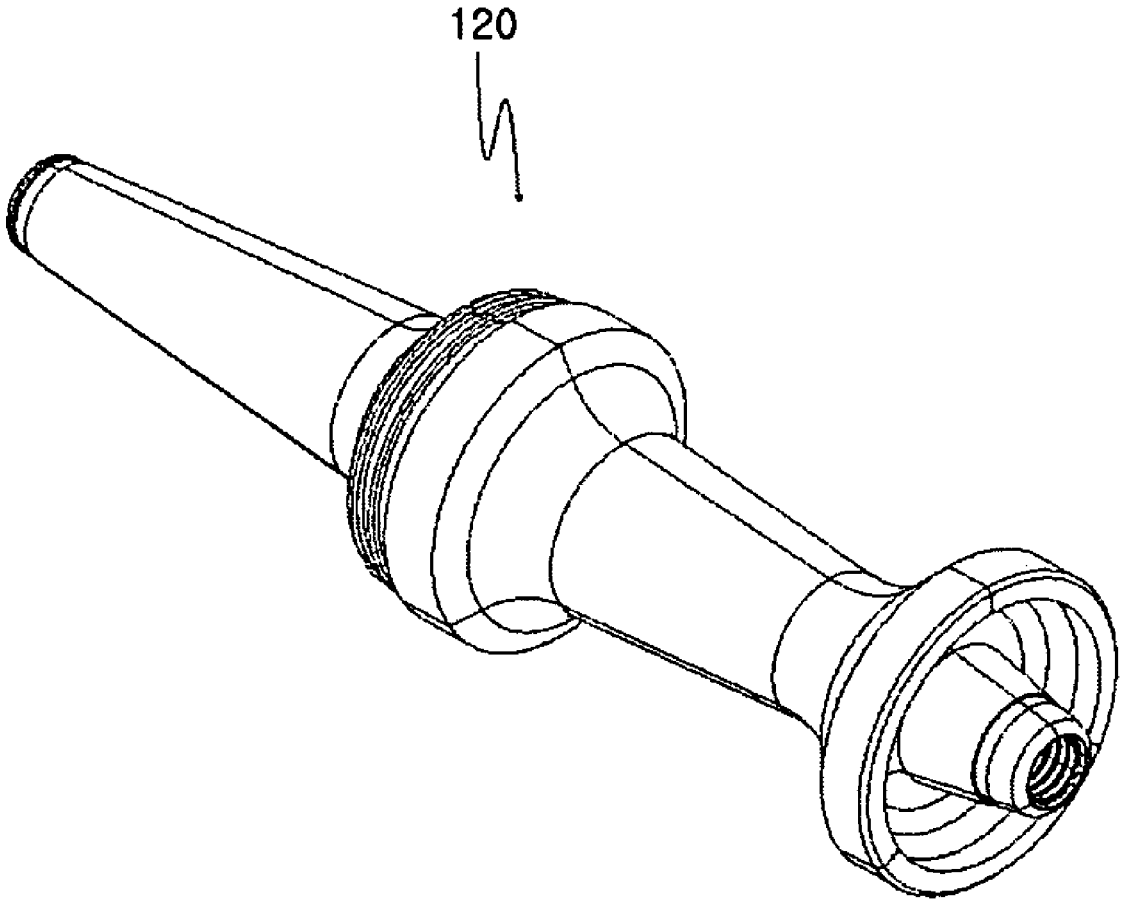
FIG. 7 is a perspective view showing the appearance of the sabot.
Figure 8:
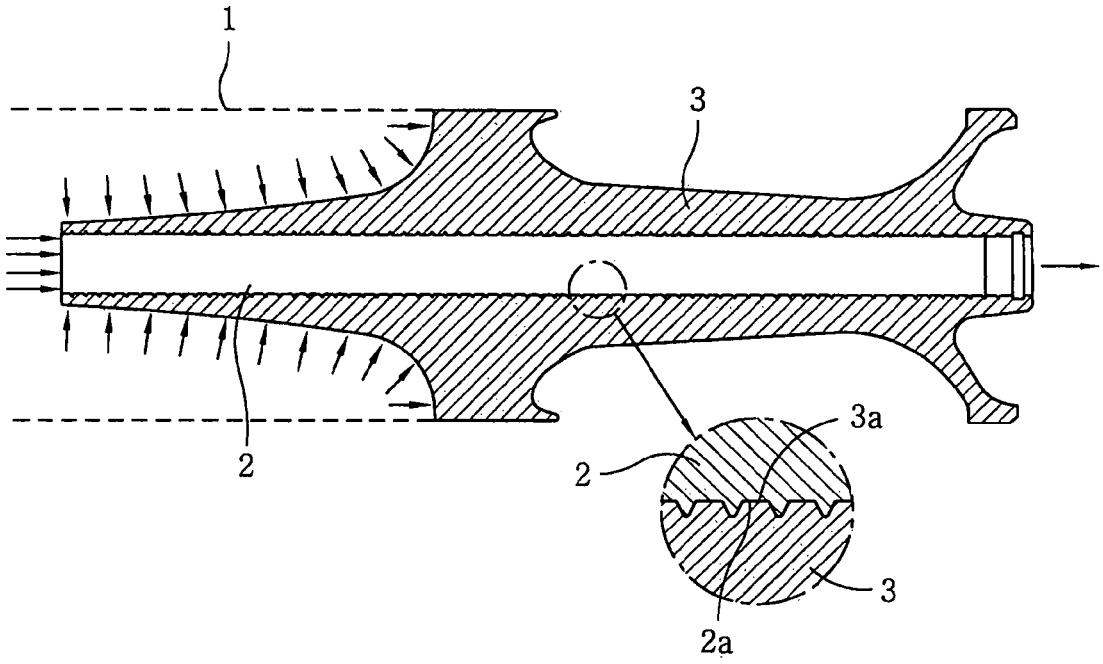
FIG. 8 is a longitudinal cross sectional view of conventional sabot configuration.

By combining three pieces 100 processed mechanically, the appearance of the composite sabot is formed as shown in FIG. 7.

According to the method of producing composite sabot of the present invention, several layers of fabric mats 10 are laminated and reinforcement material 30 such as long fiber bundle is stitched through the mat connecting the whole object, and the sabot is produced by resin-injection VARTM and mechanical processing making it possible to produce the sabot in a short period of time and also ensuring the reproducibility of high quality composite sabot.

Although the preferable example of the present invention has been described above, it should be understood not to limit the scope of the present invention and any modification can be possible to those skilled in the art within the scope of the claims.

What is claimed is:

1. A method for manufacturing a fiber-reinforced composite sabot comprising the following steps:

preparing a plurality of fiber mats having various orientation properties and forms by cutting fabric mat;

forming a pre-formed fabric object by laminating the plurality of fiber mats and stitching with reinforcing material;

forming a composite material by inserting the pre-formed fabric object into a vacuum assisted resin transfer molding apparatus to inject resin into the preformed fabric object, wherein the formed composite material has a size sufficient to form a piece of the sabot by mechanically processing the formed composite material, the piece having a size corresponding to one third of the sabot;

mechanically processing the formed composite material to form a first piece of the sabot;

forming second and third pieces of the sabot by repeating the steps recited above for forming the first piece of the sabot; and forming the sabot by combining the three pieces.

2. The method for manufacturing a fiber-reinforced composite sabot of claim 1 wherein in the step of forming the pre-formed fabric object, lamination of the plurality of fiber mats is performed considering the orientation properties of the fabric mat.

3. The method for manufacturing a fiber-reinforced composite sabot of claim 2 wherein in the step of forming preformed fabric object, stitching is performed by penetrating through a thickness direction perpendicular to the laminated fiber mats with a reinforcing material composed of long fiber bundle.

4. The method for manufacturing a fiber-reinforced composite sabot of claim 3 wherein the long fiber of the reinforcing material is one or more of fiber selected from the group consisting of carbon fiber, graphite fiber, aramid fiber and glass fiber.

5. The method for manufacturing a fiber-reinforced composite sabot of claim 1 wherein the fiber of the fabric mat is one or more of fiber selected from the group consisting of carbon fiber, graphite fiber and glass fiber.

6. The method for manufacturing a fiber-reinforced composite sabot of claim 5 wherein the resin injected into the pre-formed fabric object in the vacuum assisted resin transfer molding apparatus is thermosetting or thermoplastic resin.

7. The method for manufacturing a fiber-reinforced composite sabot of claim 2 wherein the fiber of the fabric mat is one or more of fiber selected from the group consisting of carbon fiber, graphite fiber and glass fiber.

8. The method for manufacturing a fiber-reinforced composite sabot of claim 7 wherein the resin injected into the pre-formed fabric object in the vacuum assisted resin transfer molding apparatus is thermosetting or thermoplastic resin.

9. The method for manufacturing a fiber-reinforced composite sabot of claim 3 wherein the fiber of the fabric mat is one or more of fiber selected from the group consisting of carbon fiber, graphite fiber and glass fiber.

10. The method for manufacturing a fiber-reinforced composite sabot of claim 9 wherein the resin injected into the pre-formed fabric object in the vacuum assisted resin transfer molding apparatus is thermosetting or thermoplastic resin.

* * * * *